US012509199B2

(12) United States Patent
Maldonado

(10) Patent No.: US 12,509,199 B2
(45) Date of Patent: Dec. 30, 2025

(54) PERSONAL FLOTATION DEVICE

(71) Applicant: G180, LLC, Frisco, TX (US)

(72) Inventor: Carolyn Yvonne Gardner Maldonado, Frisco, TX (US)

(73) Assignee: G180, LLC, Frisco, TX (US)

( * ) Notice: Subject to any disclaimer, the term of this patent is extended or adjusted under 35 U.S.C. 154(b) by 445 days.

(21) Appl. No.: 18/114,945

(22) Filed: Feb. 27, 2023

(65) Prior Publication Data

US 2023/0271684 A1 Aug. 31, 2023

Related U.S. Application Data

(60) Provisional application No. 63/314,929, filed on Feb. 28, 2022.

(51) Int. Cl.
*B63C 9/125* (2006.01)
*B63C 9/00* (2006.01)

(52) U.S. Cl.
CPC ..... *B63C 9/1255* (2013.01); *B63C 2009/007* (2013.01)

(58) Field of Classification Search
CPC ..... B63C 9/1255; B63C 2009/007
See application file for complete search history.

(56) References Cited

U.S. PATENT DOCUMENTS 11,820,472 B1 * 11/2023 Capezzuto ..... B63C 9/20

FOREIGN PATENT DOCUMENTS

| | | | | |
|---|---|---|---|---|
| AT | 354920 B | * | 2/1980 | ..... A62B 35/0006 |
| AU | 2007234471 A1 | * | 5/2008 | ..... B63C 11/30 |
| GB | 2559773 A | * | 8/2018 | ..... A41D 13/0125 |
| WO | WO-2005002674 A2 | * | 1/2005 | ..... B63C 11/30 |

* cited by examiner

*Primary Examiner* — S. Joseph Morano
*Assistant Examiner* — Jovon E Hayes
(74) *Attorney, Agent, or Firm* — Lathrop GPM LLP

(57) ABSTRACT

A personal flotation device includes a burst zipper connected to a back panel, a left panel, and a right panel of a shell of the personal flotation device. The personal flotation device further includes an inflatable bladder sewn into a seam of the shell of the personal flotation device. The seam extends through one or more of a neck panel, the left panel, and the right panel of the shell. The personal flotation device further includes strap components connected between the back panel and the left panel and the right panel. The strap components are configured to secure the left panel and the right panel to the back panel.

18 Claims, 9 Drawing Sheets

PERSONAL FLOTATION DEVICE

CROSS REFERENCE

This application claims the benefit of U.S. Provisional Application 63/314,929, filed Feb. 28, 2022, which is hereby incorporated by reference herein.

BACKGROUND

Personal flotation devices are used to keep the wearer afloat in water. The US Coast Guard regulates personal flotation devices. A challenge is for a personal flotation device to meet regulatory requirements and fit the user while being comfortable to wear and reducing bulk.

SUMMARY

In general, in one or more aspects, the disclosure relates to a personal flotation device that includes a burst zipper connected to a back panel, a left panel, and a right panel of a shell of the personal flotation device. The personal flotation device further includes an inflatable bladder sewn into a seam of the shell of the personal flotation device. The seam extends through one or more of a neck panel, the left panel, and the right panel of the shell. The personal flotation device further includes strap components connected between the back panel and the left panel and the right panel. The strap components are configured to secure the left panel and the right panel to the back panel.

In general, in one or more aspects, the disclosure relates to a method for a personal flotation device. The method includes connecting a burst zipper to a back panel, a left panel, and a right panel of a shell of a personal flotation device. The method further includes sewing an inflatable bladder into a seam of the shell of the personal flotation device. The seam extends through one or more of a neck panel, the left panel, and the right panel of the shell. The method further includes connecting strap components between the back panel and the left panel and the right panel. The strap components are configured to secure the left panel and the right panel to the back panel.

In general, in one or more aspects, the disclosure relates to a system of a personal flotation device. The system includes a burst zipper, an inflatable bladder, and strap components. The burst zipper is connected to a back panel, a left panel, and a right panel of a shell of a personal flotation device. The burst zipper is configured to tear apart when the inflatable bladder secured to the shell is inflated. The inflatable bladder sewn into a seam of the shell of the personal flotation device. The seam extends through one or more of a neck panel, the left panel, and the right panel of the shell. The strap components connected between the back panel and the left panel and the right panel. The strap components are configured to secure the left panel and the right panel to the back panel.

DETAILED DESCRIPTION

Figure 1:
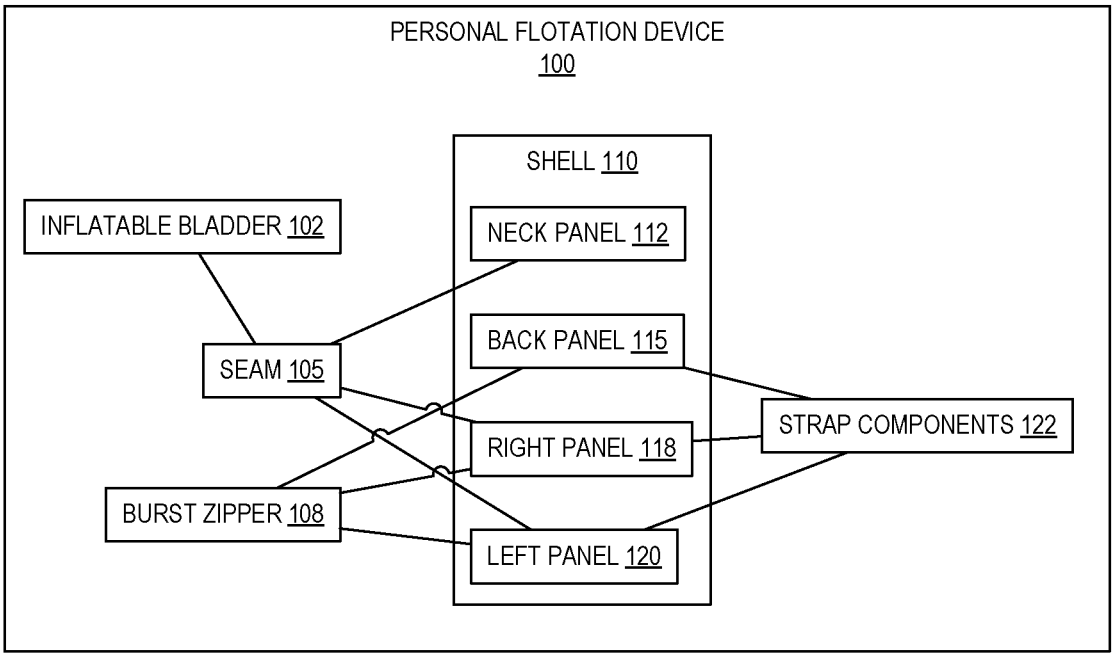
FIG. 1 shows a diagram of a personal flotation device in accordance with the disclosure.

Specific embodiments will now be described in detail with reference to the accompanying figure. Like elements in the figure are denoted by like reference numerals for consistency.

In the following detailed description, numerous specific details are set forth in order to provide a more thorough understanding of the disclosure. However, it will be apparent to one of ordinary skill in the art that the disclosed embodiments may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure implement a personal flotation device that meets regulatory requirements, is comfortable to wear, and reduces bulk. Embodiments of the disclosure provide a personal flotation device that incorporates a sleek and fashionable design. Additionally, embodiments of the disclosure provide a snug comfortable fit to the user, which increases the likelihood that the user will wear embodiments of the disclosed personal flotation device. The fit of the personal flotation device is similar to that of a sports bra or sports harness with elastic support.

In one embodiment, the personal flotation device includes an outer shell made from a combination of panels of fabric. The panels of the personal flotation device make up the outer shell and the combination of the shell and the bladder make the device a personal flotation device. Examples of panels of fabric that may form the outer shell of the personal flotation device may be seen in the figures.

The bladder of the personal flotation device may include multiple panels. The panels of the bladder are RF (radio frequency) welded to form an air tight, water tight, gas tight ($CO_2$) seal.

US Coast Guard regulations identify multiple types of personal flotation devices (PFDs). A Type V Hybrid PFD is an inflatable device which can be the most comfortable and has very little buoyancy when it is not inflated, and considerably more buoyancy when it is inflated. In order for the device to count toward carriage requirements on recreational boats, it must be worn except when the boat is not underway or when the user is below deck. When inflated it turns the wearer similar to the action provided by a Type I, II, or III PFD (the type of performance is indicated on the label). This type of PFD is more comfortable because it is less bulky when it is not inflated. Wearers taking advantage of the extra comfort of hybrid inflatable PFDs must take additional care in the use of these devices. Wearers should test their hybrid PFDs in the water, under safe, controlled conditions to know how well the devices float them with limited buoyancy. Approximately 70 percent of wearers will float while wearing a Type V hybrid PFD when the device is not inflated. Therefore, it is not recommended for non-swimmers unless worn with enough additional inflation to float the wearer.

The PFD's "performance type" indicates whether it should be used only where help is nearby, or if it may also be used where help may be slow coming. This type of PFD is approved in two sizes, adult, for persons weighing over 40 kilograms (90 pounds); and youth, for persons weighing 23-40 kilograms (50-90 pounds), and may be available in a number of chest sizes and in universal adult sizes.

The figures show diagrams of embodiments that are in accordance with the disclosure. The embodiments of the figures may be combined and may include or be included within the features and embodiments described in the other figures of the application. The features and elements of the figures are, individually and as a combination, improvements to the technology of fiber and cable enclosures. The various elements, systems, components, and steps shown in the figures may be omitted, repeated, combined, and/or altered as shown from the figures. Accordingly, the scope of the present disclosure should not be considered limited to the specific arrangements shown in the figures.

Turning to FIG. 1, the personal flotation device (100) may be worn by a user to provide buoyancy when needed. The personal flotation device (100) includes the inflatable bladder (102), the seam (105), the burst zipper (108), the shell (110), and the strap components (122).

The inflatable bladder (102) is a bladder made of a water tight material that may be inflated to provide buoyancy. The inflatable bladder (102) is connected to the seam (105).

The seam (105) connects between the inflatable bladder (102) and the shell (110). The seam (105) runs along the neck panel (112), the right panel (118), and the left panel (120) of the shell (110).

The burst zipper (108) is a zipper that is connected to multiple panels of the shell (110), including the back panel (115), the right panel (118), and the left panel (120). When the inflatable bladder (102) is not inflated, the burst zipper (108) secures multiple panels of the shell (110) together to keep a flat profile of the personal flotation device (100). When the inflatable bladder (102) is inflated. the burst zipper (108) bursts open to make room for the increased size of the inflatable bladder (102).

The shell (110) is a collection of fabric panels that enclose the inflatable bladder (102). The panels of the shell (110) may be customized and cut to fit certain shapes of torsos. For example, a woman's shell may include panels cut to fit the chest of a woman and a man's shell may include panels cut to fit the chest of a man. The shell (110) includes the neck panel (112), the back panel (115), the right panel (118), and the left panel (120). The panels may be made of different types, styles, and colors of fabric.

The neck panel (112) includes at least a part of the seam (105) to connect with the inflatable bladder (102). In one embodiment, the neck panel (112) may also connect with the back panel (115) by the burst zipper (108).

The back panel (115), the right panel (118), and the left panel (120) form a part of the shell (110). Each of the back panel (115), the right panel (118), and the left panel (120) may connect to the burst zipper (108). In one embodiment, back panel (115), the right panel (118), and the left panel (120) may be interconnected with the strap components (122).

The strap components (122) support various portions of the personal flotation device (100). The strap components (122) secure the personal flotation device (100) to the user of the personal flotation device (100).

Figure 2:
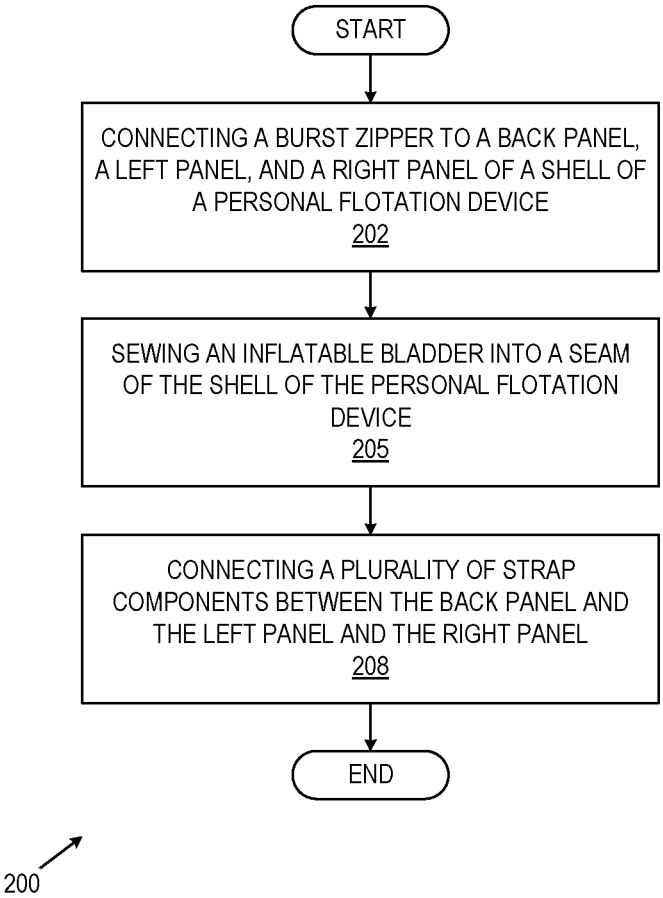
FIG. 2 shows a method of manufacturing a personal flotation device in accordance with the disclosure.

Turning to FIG. 2, the process (200) is a method of manufacturing a personal flotation device. The personal flotation device may be used by a user to provide buoyancy.

At Step 202, a burst zipper is connected to a back panel, a left panel, and a right panel of a shell of a personal flotation device. The burst zipper may be connected by sewing an edge of the burst zipper to edges of the back panel, left panel, and right panel. The burst zipper may also connect between a neck panel and the back panel.

In one embodiment, a pocket is formed in one of the right panel and the left panel. The pocket may include a fastener and conceals a pull tab configured to inflate the inflatable bladder. Types of fasteners may include hook-and-loop fasteners, hook-and-pile fasteners, touch fasteners, velcro fasteners, buttons, zippers, etc. The pocket may conceal a pull tab connected to a string that forms a lanyard pull-tab that, when pulled, opens a compressed gas cartridge to inflate the inflatable bladder. In one embodiment, the string may be connected to a ball (instead of the pull-tab) to form a ball lanyard.

In one embodiment, the left panel and the right panel are connected with a center front zipper. The center front zipper is used to releasably connect the left and right panels so that a user may put on and remove the personal flotation device.

In one embodiment, the burst zipper is formed from a chain of multiple teeth. In one embodiment, the burst zipper further includes a burst point with teeth that do not interlock. The noninterlocking teeth create the burst point, which is a weak point in the burst zipper that opens first when the inflatable bladder is inflated. In one embodiment, the burst zipper is configured to tear apart when the inflatable bladder secured within the shell is inflated.

At Step 205, an inflatable bladder is sewn into a seam of the shell of the personal flotation device. The seam extends through one or more of a neck panel, the left panel, and the right panel of the shell. In one embodiment, the shell may be from multiple panels that are sewn together before sewing the inflatable bladder to the shell.

At Step 208, strap components are connected between the back panel and the left panel and the right panel. The strap components may be configured to secure the left panel and the right panel to the back panel. The strap components may be sewn on one or multiple panels.

In one embodiment, the strap components include at least one underarm strap connected between the back panel and one of the left panel and the right panel. In one embodiment, the underarm straps are configured to prevent the personal flotation device from riding up after inflation of the inflatable bladder and is configured to ensure the personal flotation device lays flat on a chest of a user of the personal flotation device.

In one embodiment, the strap components include a bottom strap component that is connected below an underarm panel at a bottom end of the personal flotation device and is connected between the back panel and at least one of the left panel and the right panel. In one embodiment, the bottom strap is configured to secure the shell to a body of a user of the personal flotation device and configured to ensure the personal flotation device does not ride up.

In one embodiment, the strap components include a first crossover strap component connected between an underarm strap component and a bottom strap component and crossing over a second crossover strap. The crossover design provides comfort for long wear of the personal flotation device.

Figure 3A:
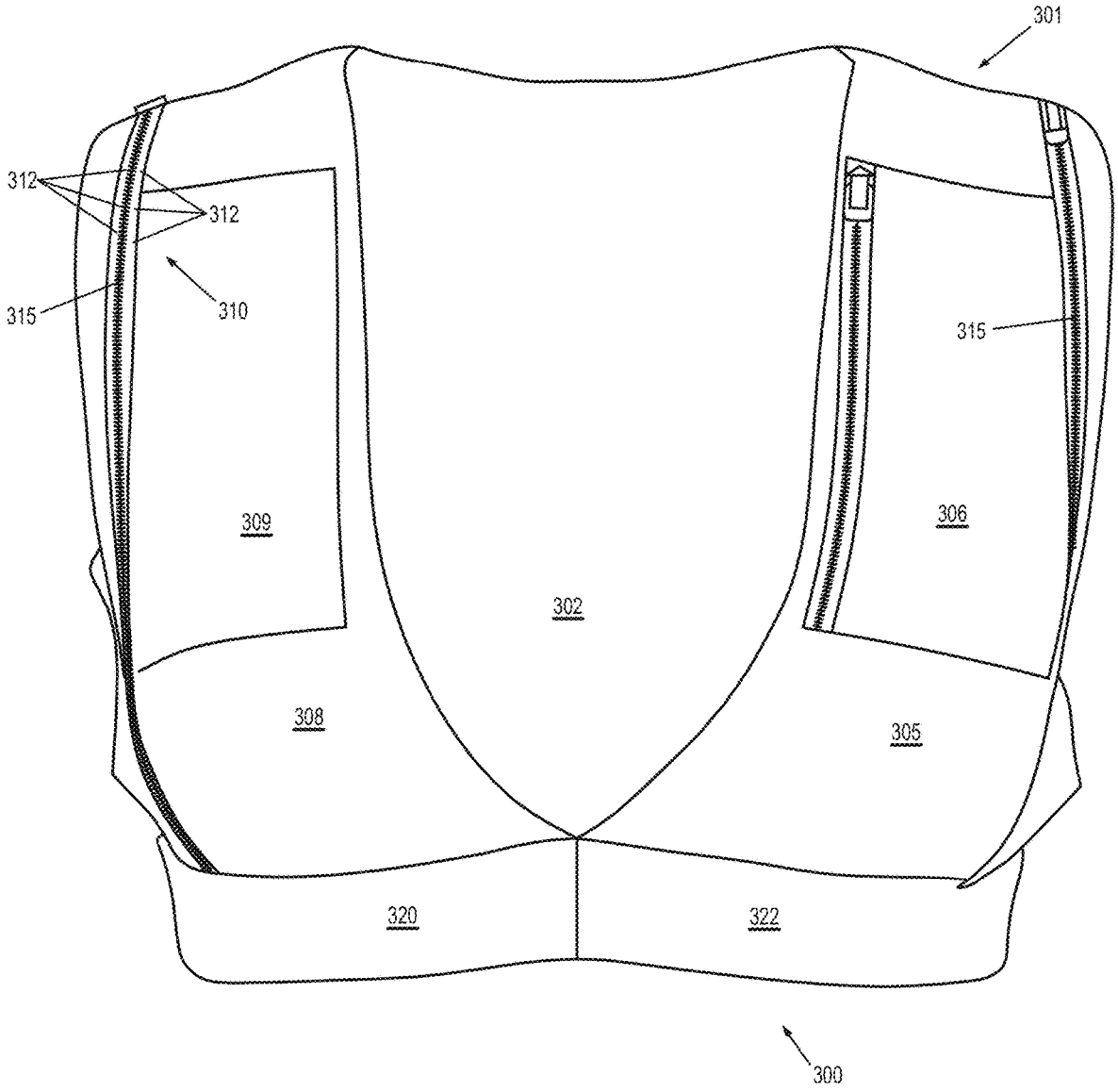
FIG. 3A, FIG. 3B, FIG. 3C, FIG. 3D, FIG. 4A, FIG. 4B, FIG. 4C, and FIG. 4D show examples of a personal flotation device in accordance with the disclosure.

Turning to FIG. 3A, a front view is illustrated. The personal flotation device (300) includes the interior back panel (302), the left panel (305), and the right panel (308). The burst zipper (310) includes multiple teeth (312) forming a chain (315) extending through the exterior back panel (352), the left panel (305), and the right panel (308). An inflatable bladder is sewn into a seam of the shell (301) of the personal flotation device (300) and extends through the interior back panel (352), the left panel (305), and the right panel (308). The strap components (320), (322), (325) (of FIG. 3B), (328) (of FIG. 3C), (330) (of FIG. 3C), and (332) (of FIG. 3C) secure the personal flotation device to lay flat on a chest area of a wearer of the personal flotation device. The strap components (320), (322), (325) (of FIG. 3B), (328) (of FIG. 3C), (330) (of FIG. 3C), and (332) (of FIG. 3C) prevent horizontal movement of the personal flotation device (300) when the inflatable bladder is inflated. The straps formed form the strap components (320), (322), (325) (of FIG. 3B), (328) (of FIG. 3C), (330) (of FIG. 3C), and (332) (of FIG. 3C) secure the device to the body in a secure and comfortable way. The shell (301) is designed to lay flat on the body of the wearer and provide the wearer with maximum mobility as well as a sleek aesthetic. The personal flotation device (300) may be manufactured by incorporating (e.g., sewing) the component parts of the personal flotation device (300) together.

In one embodiment, the personal flotation device includes an automated inflation system comprising a pull tab. In one embodiment, the automated inflation system is concealed in the right panel (308) in the pocket (309). In one embodiment, the pocket (309) is closable with a velcro fastener.

In one embodiment, the personal flotation device includes a manual inflation tube. In one embodiment, the manual inflation tube is concealed in the left panel (305) in the pocket (306). In one embodiment, the pocket (306) is closable with a zipper.

Figure 3B:
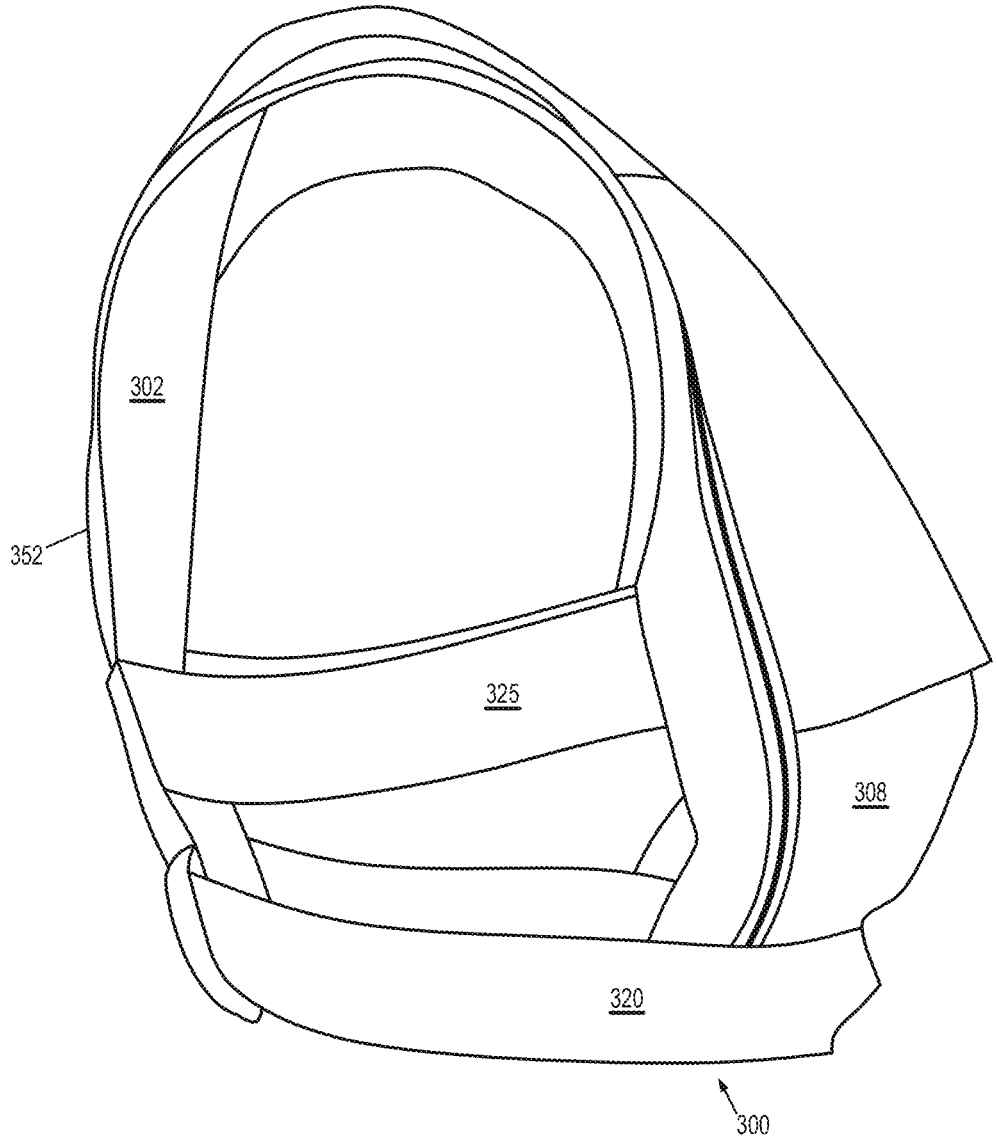

Turning to FIG. 3B, a right side view is illustrated. The personal flotation device (300) includes the chain (315) of the burst zipper extending through the right panel (308) and the exterior back panel (352). The exterior back panel (352) is opposite the interior back panel (302). The personal flotation device (300) further includes the strap components (320) and (325).

Figure 3C:
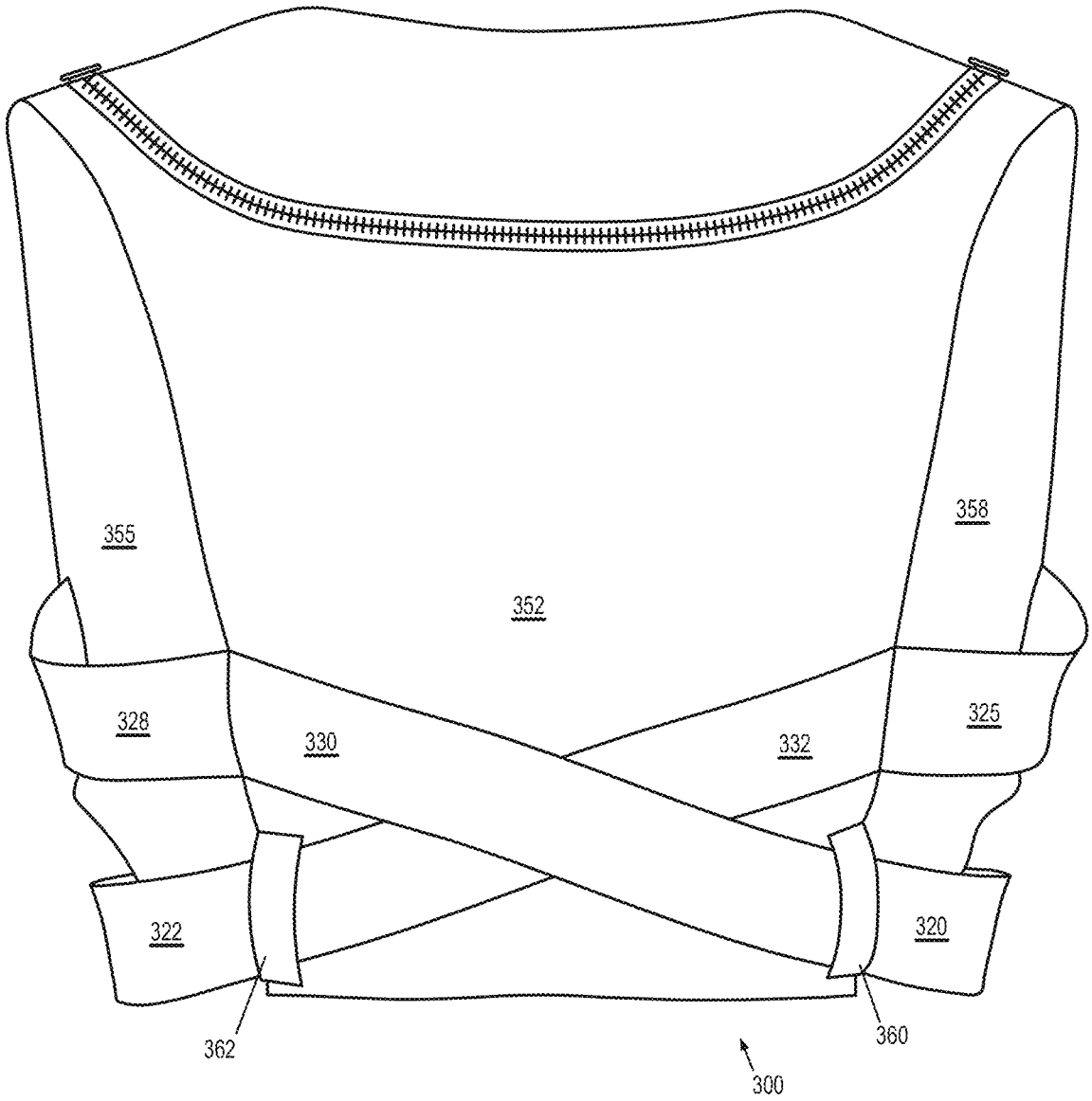

Turning to FIG. 3C, a back side view is illustrated. The personal flotation device (300) includes the exterior back panel (352), the interior left panel (355), and the interior right panel (358). The personal flotation device (300) further includes the strap components (320), (322), (325), (328), (330), and (332). The personal flotation device (300) further includes the belt loop (360) through which the strap component (320) is fitted and the belt loop (362) through which the strap component (322) is fitted.

Figure 3D:
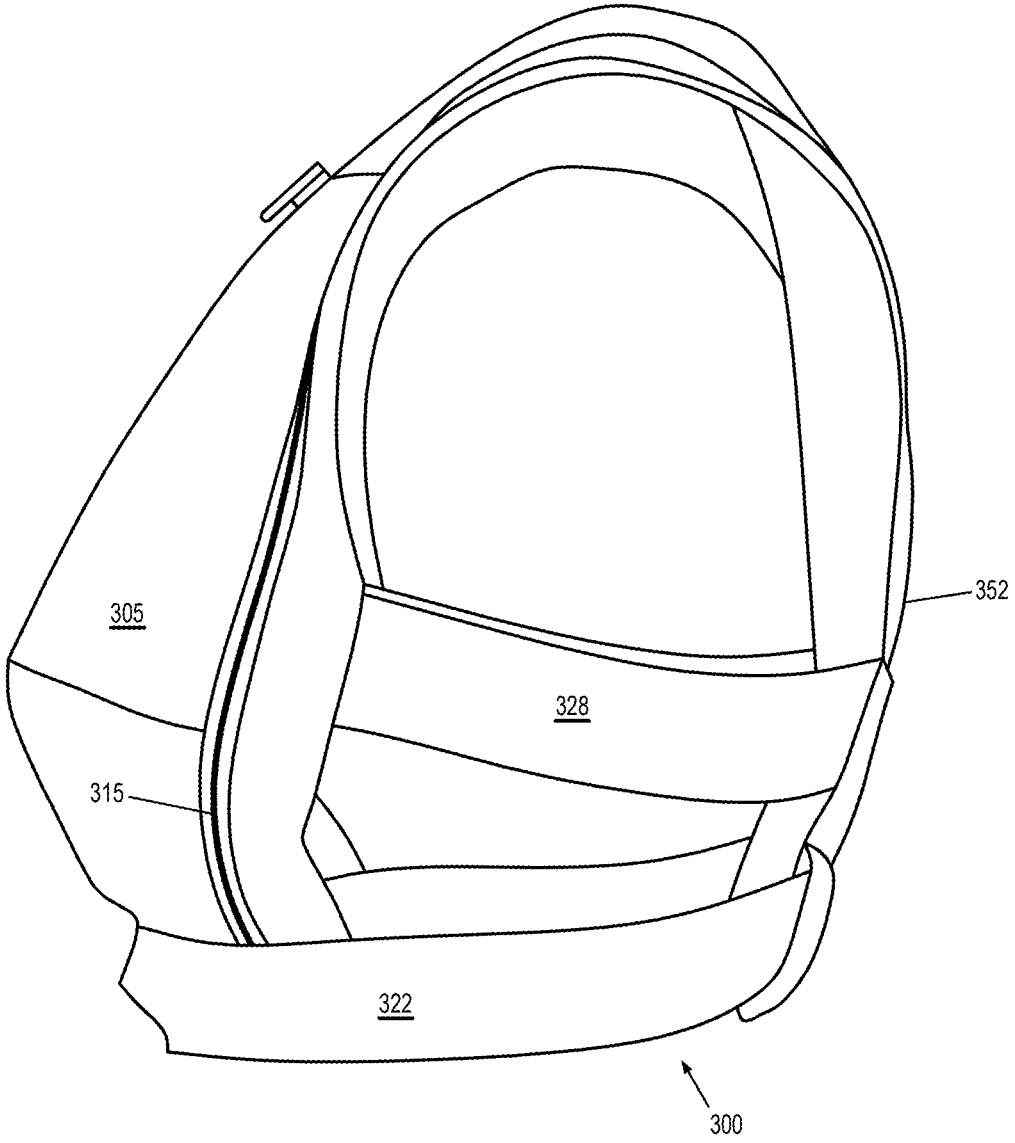

Turning to FIG. 3D, a left side view is illustrated. The personal flotation device (300) includes the chain (315) extending through the left panel (305). The personal flotation device (300) further includes the strap components (322) and (328) connected to the exterior back panel (352).

Figure 4A:
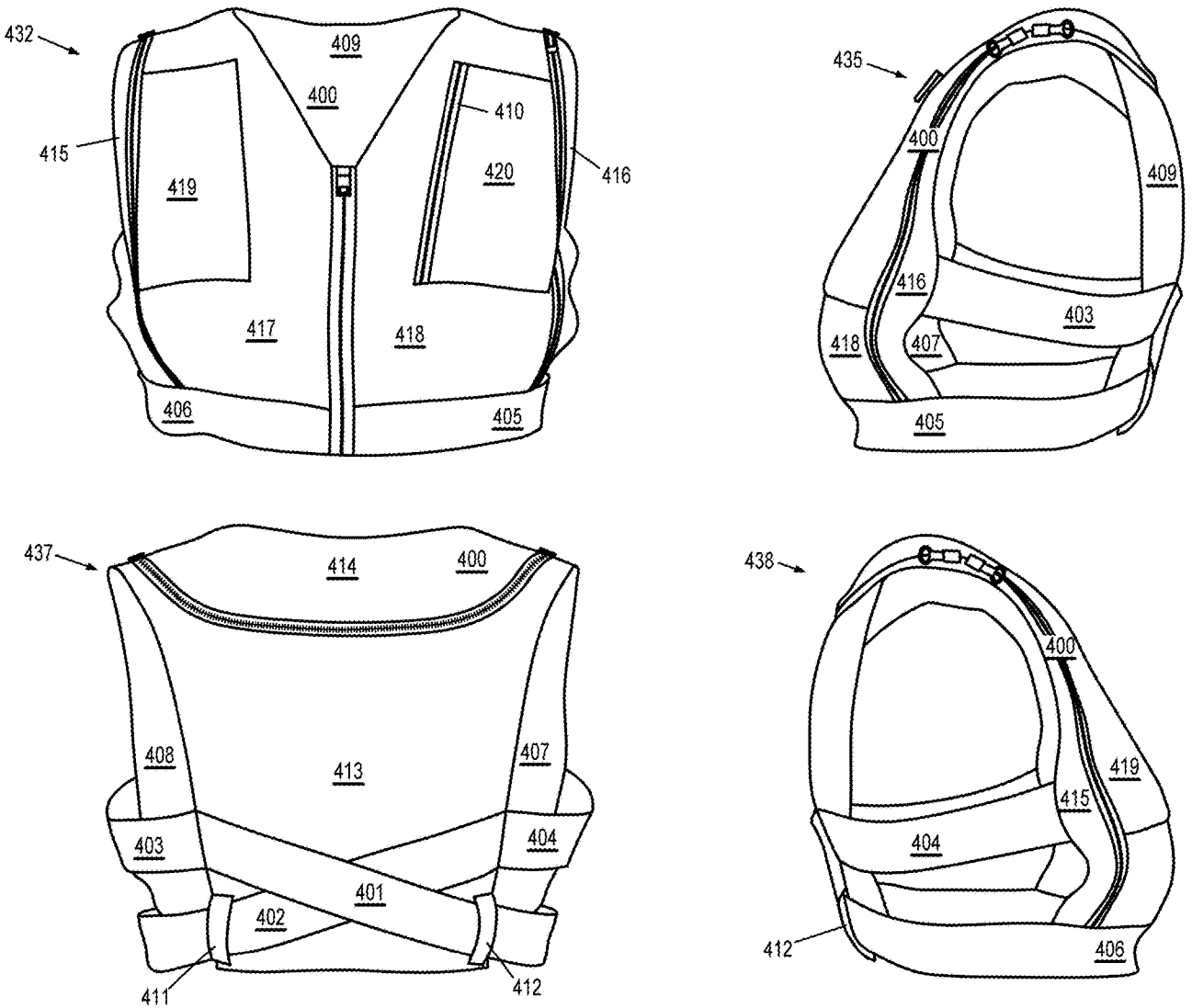
Figure 4B:
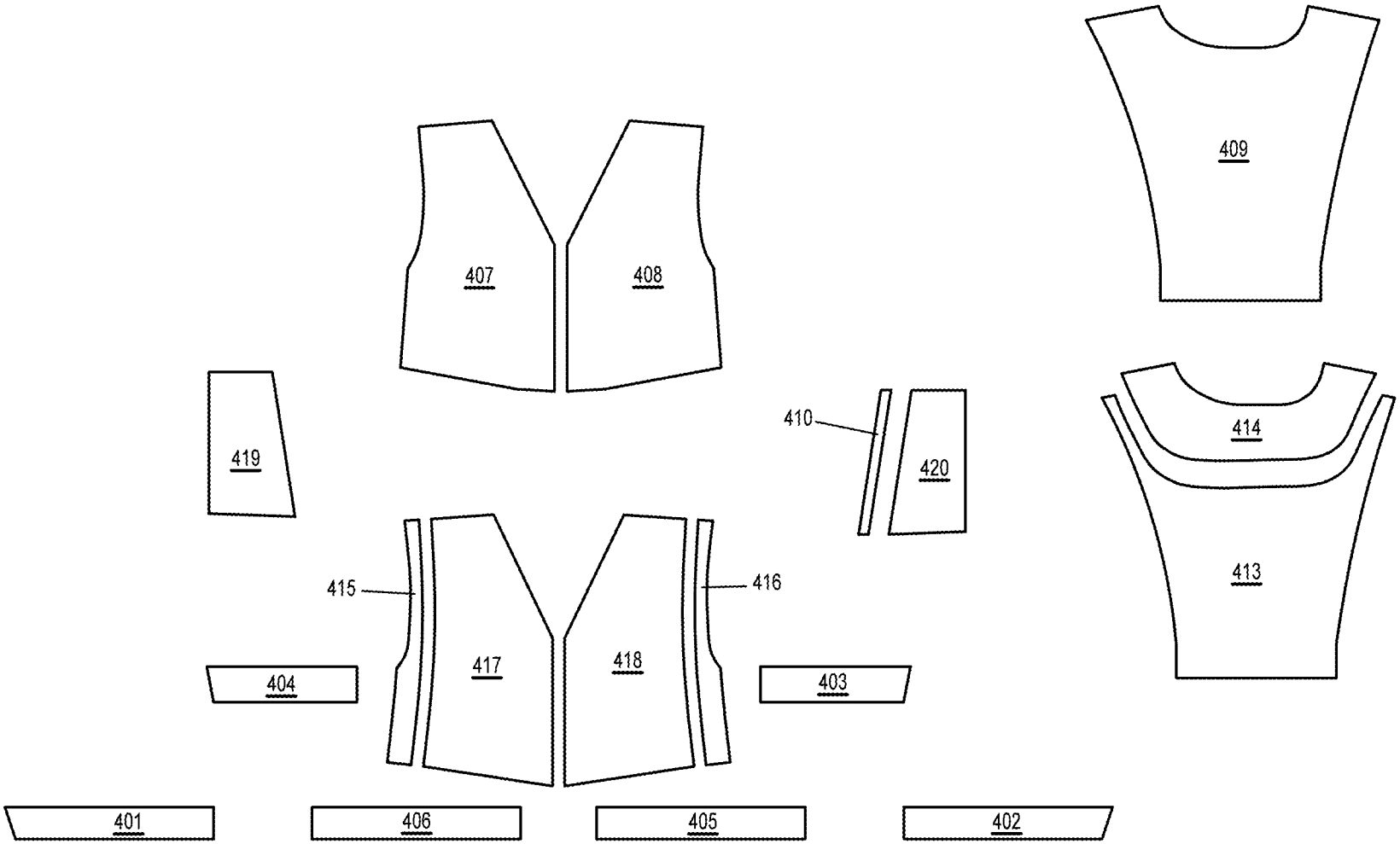

FIGS. 4A and 4B show multiple views of the fabric panels used to construct the personal flotation device. FIG. 4A shows different view of the personal flotation device (400) after being constructed. FIG. 4B shows a view of the individual fabric panels used to construct the personal flotation device (400).

Turning to FIG. 4A, the front view (432) shows a front side of the personal flotation device (400). The front view (432) shows the interior back panel (409) on a back side of the personal flotation device (400). The personal flotation device (400) further includes a right side with the right pocket panel (419), the right outer panel (415), the right exterior panel (417), and the strap component (406).

The left side view (435) shows a left side of the personal flotation device (400). The left side view (435) shows the interior back panel (409), the left underarm strap component (403), the left outer panel (416), the left interior panel (407), the left exterior panel (418), and the strap component (405).

The back view (437) shows a back view of the personal flotation device (400). The back view (437) shows the neck panel (414), the exterior back panel (413), the right interior panel (408), the left underarm strap component (403), the left belt loop (411), the second crossover strap (402), the first crossover strap (401), the right belt loop (412), the right underarm strap component (404), and the left interior panel (407).

The right side view (438) shows a right side view of the personal flotation device (400). The right side view (438) shows the right pocket panel (419), the right outer panel (415), the right underarm strap component (404), the right belt loop (412), and the strap component (406).

Turning to FIG. 4B, the individual fabric panels and strap components that make the shell of the personal flotation device (400) (of FIG. 4A) are shown. The interior fabric panels include the left interior panel (407), the right interior panel (408), the interior back panel (409). The exterior fabric panels include the exterior back panel (413), the neck panel (414), the left outer panel (416), the left exterior panel (418), the right exterior panel (417), and the right outer panel (415). The right pocket panel (419) may be sewn onto the right exterior panel (417). The left pocket panel (420) and the pocket zipper panel (410) may be sewn onto the left exterior panel (418). The strap components include the left underarm strap component (403), the right underarm strap component (404), the strap component (405), the strap component (406), the first crossover strap (401), and the second crossover strap (402).

When connected the panels and strap components form the outer shell of the personal flotation device (400) (of FIG. 4A) to which an inflatable bladder may be affixed.

Figure 4D:
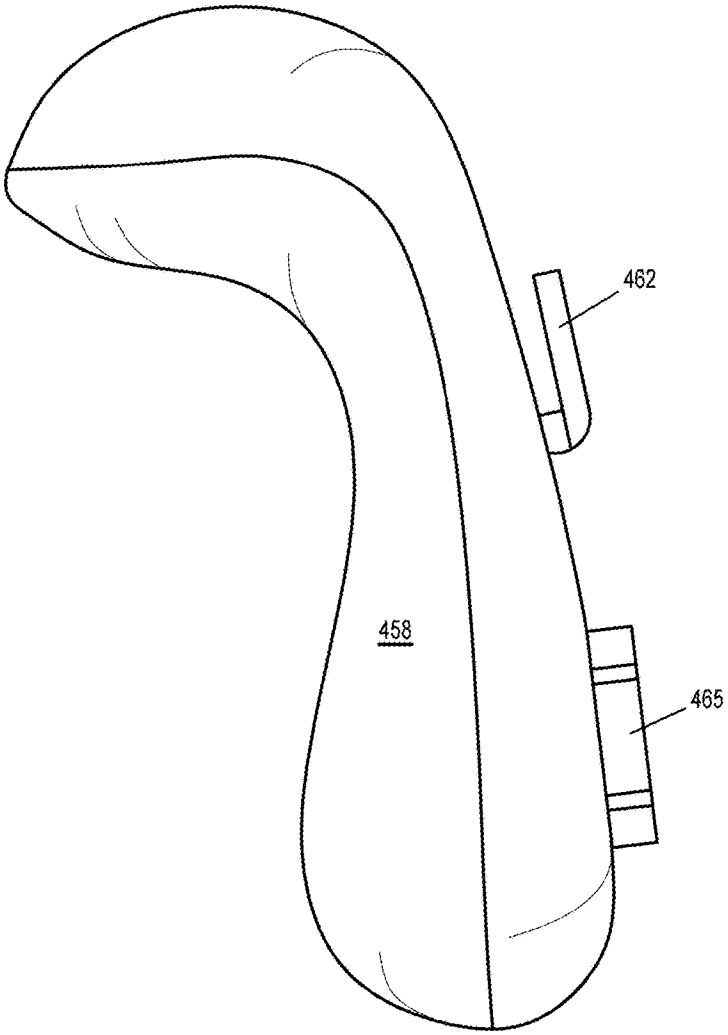
Figure 4C:
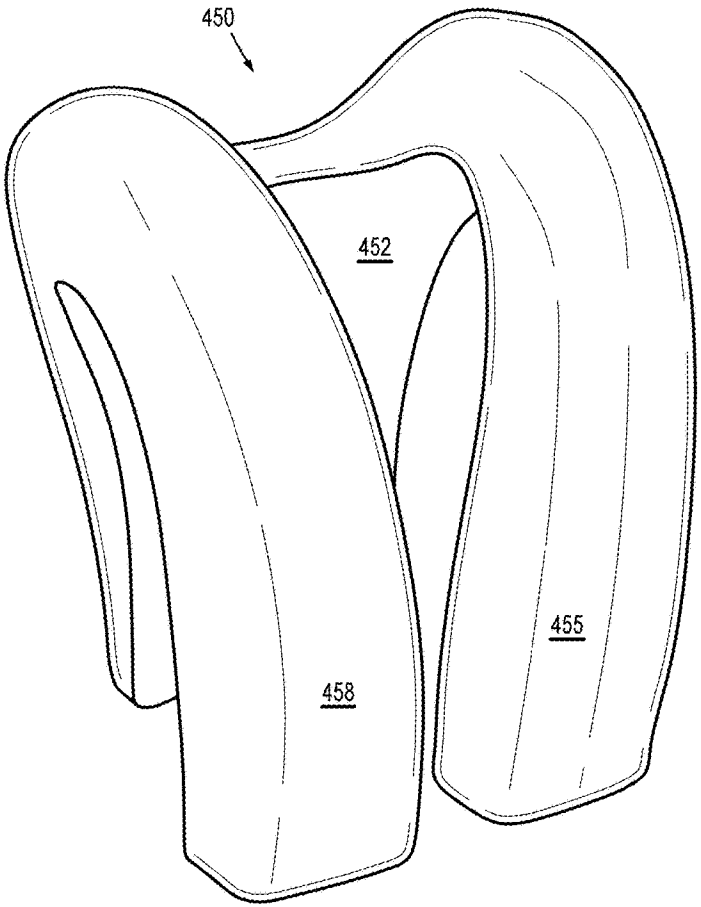

Turning to FIG. 4C, the inflatable bladder (450) is inflated. Prior to inflation, the inflatable bladder (450) may be inserted into the shell of the personal flotation device (400) of FIG. 4A. The inflatable bladder (450) is a single bladder that includes the back bladder portion (452), the left bladder portion (455), and the right bladder portion (458).

Turning to FIG. 4D, the right bladder portion (458) is shown. The right bladder portion (458) includes the manual tube (462) and the compressed gas cartridge (465). The manual tube (462) connects to the right bladder portion (458) to allow the user of the personal flotation device to manually inflate the inflatable bladder (450) (of FIG. 4C). The compressed gas cartridge (465) is connected to the right bladder portion (458) and may be used to automatically inflate the inflatable bladder (450) (of FIG. 4C). For example, the compressed gas cartridge (465) may release compressed gas into the inflatable bladder (450) (of FIG. 4C) upon the pulling of a pull tab.

The term "about," when used with respect to a physical property that may be measured, refers to an engineering tolerance expected by or determined by one of ordinary skill in the art. The exact quantified degree of an engineering tolerance depends on the product being produced, the process being performed, or the technical property being measured. For a non-limiting example, two angles may be "about congruent" if the values of the two angles are within ten percent of each other. However, if the ordinary artisan determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A could have been separate from component B, but is joined to component B in either a fixed or a removably attached arrangement. In a second meaning, unless otherwise stated, "connected to" means that component A is integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process.

In the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, the term "or" is an "inclusive or" and, as such, includes the term "and." Further, items joined by the term "or" may include any combination of the items with any number of each item, unless expressly stated otherwise.

In the above description, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description. Further, other embodiments not explicitly described above can be devised which do not depart from the scope of the invention as disclosed herein. Accordingly, the scope of the invention should be limited only by the attached claims.

What is claimed is:

1. A personal flotation device comprising:

a burst zipper connected to a back panel, a left panel, and a right panel of a shell of the personal flotation device, wherein the burst zipper comprises a burst point with teeth that do not interlock;

an inflatable bladder sewn into a seam of the shell of the personal flotation device, wherein the seam extends through one or more of a neck panel, the left panel, and the right panel of the shell; and a plurality of strap components connected between the back panel and the left panel and the right panel, wherein the plurality of strap components is configured to secure the left panel and the right panel to the back panel.

2. The personal flotation device of claim 1, wherein the plurality of strap components are configured to prevent horizontal movement of the personal flotation device when the inflatable bladder is inflated.

3. The personal flotation device of claim 1, further comprising:

a pocket formed in one of the right panel and the left panel, wherein the pocket comprises a fastener and conceals a pull tab configured to inflate the inflatable bladder.

4. The personal flotation device of claim 1, further comprising:

the left panel and the right panel connected with a center front zipper.

5. The personal flotation device of claim 1, wherein the plurality of strap components comprises an underarm strap connected between the back panel and one of the left panel and the right panel, and wherein the underarm strap is configured to prevent the personal flotation device from riding up after inflation of the inflatable bladder and is configured to ensure the personal flotation device lays flat on a chest of a user of the personal flotation device.

6. The personal flotation device of claim 1, wherein the plurality of strap components comprises a bottom strap component that is connected below an underarm panel at a bottom end of the personal flotation device and is connected between the back panel and one of the left panel and the right panel, and wherein the bottom strap is configured to secure the shell to a body of a user of the personal flotation device and configured to ensure the personal flotation device does not ride up.

7. The personal flotation device of claim 1, wherein the plurality of strap components comprises a first crossover strap component connected between an underarm strap component and a bottom strap component and crossing over a second crossover strap.

8. The personal flotation device of claim 1, wherein the burst zipper is formed from a chain of a plurality of teeth.

9. The personal flotation device of claim 1, wherein the burst zipper is configured to tear apart when the inflatable bladder secured to the shell is inflated.

10. A method comprising:

connecting a burst zipper to a back panel, a left panel, and a right panel of a shell of a personal flotation device, wherein the burst zipper comprises a burst point with teeth that do not interlock;

sewing an inflatable bladder into a seam of the shell of the personal flotation device, wherein the seam extends through one or more of a neck panel, the left panel, and the right panel of the shell; and connecting a plurality of strap components between the back panel and the left panel and the right panel, wherein the plurality of strap components is configured to secure the left panel and the right panel to the back panel.

11. The method of claim 10, further comprising:

connecting the plurality of strap components, wherein the plurality of strap components are configured to prevent horizontal movement of the personal flotation device when the inflatable bladder is inflated.

12. The method of claim 10, further comprising:

forming a pocket in one of the right panel and the left panel, wherein the pocket comprises a fastener and conceals a pull tab configured to inflate the inflatable bladder.

13. The method of claim 10, further comprising:

connecting the left panel and the right panel with a center front zipper.

14. The method of claim 10, further comprising:

connecting a plurality of strap components, wherein the plurality of strap components comprises an underarm strap connected between the back panel and one of the left panel and the right panel, and wherein the underarm strap is configured to prevent the personal flotation device from riding up after inflation of the inflatable bladder and is configured to ensure the personal flotation device lays flat on a chest of a user of the personal flotation device.

15. The method of claim 10, further comprising:

connecting a plurality of strap components, wherein the plurality of strap components comprises a bottom strap component that is connected below an underarm panel at a bottom end of the personal flotation device and is connected between the back panel and one of the left panel and the right panel, and wherein the bottom strap is configured to secure the shell to a body of a user of the personal flotation device and configured to ensure the personal flotation device does not ride up.

16. The method of claim 10, further comprising:

connecting a plurality of strap components, wherein the plurality of strap components comprises a first crossover strap component connected between an underarm strap component and a bottom strap component and crossing over a second crossover strap.

17. The method of claim 10, further comprising:

connecting the burst zipper, wherein the burst zipper is formed from a chain of a plurality of teeth.

18. A system comprising:

a burst zipper, an inflatable bladder, and a plurality of strap components, the burst zipper connected to a back panel, a left panel, and a right panel of a shell of a personal flotation device, wherein the burst zipper is configured to tear apart when the inflatable bladder secured to the shell is inflated, wherein the burst zipper comprises a burst point with teeth that do not interlock;

the inflatable bladder sewn into a seam of the shell of the personal flotation device, wherein the seam extends through one or more of a neck panel, the left panel, and the right panel of the shell; and the plurality of strap components connected between the back panel and the left panel and the right panel, wherein the plurality of strap components is configured to secure the left panel and the right panel to the back panel.

* * * * *